US006000734A

United States Patent [19]

Prevot et al.

[11] Patent Number: 6,000,734

[45] Date of Patent: Dec. 14, 1999

[54] LOCK FOR SLIDING DOOR, WINDOW OR LIKE CLOSURE

[75] Inventors: Gérard Prevot, deceased, late of Willerwald, by Nadine Prevot, legal representative; Gérard Desplantes, Sarrebourg; Eric Alvarez, Hommert, all of France

[73] Assignee: Ferco International Ferrures et Serrures de Batiment, Reding, France

[21] Appl. No.: 09/085,862

[22] Filed: May 28, 1998

[30] Foreign Application Priority Data

May 30, 1997 [FR] France ..... 97 06691

[51] Int. Cl.[6] ..... E05C 19/06

[52] U.S. Cl. ..... 292/99; 292/DIG. 46

[58] Field of Search ..... 292/98, 99, 132, 292/170, 302, 333, 254, DIG. 46, DIG. 53, 169.14; 49/322, 449, 503; 70/95, 370, 450, 451

[56] References Cited

U.S. PATENT DOCUMENTS

| | | | |
|---|---|---|---|
| 2,226,735 | 12/1940 | Miller . | |
| 2,294,683 | 9/1942 | Murphy . | |
| 3,050,322 | 8/1962 | Miller . | |
| 3,870,353 | 3/1975 | Miller | 292/37 |
| 4,061,372 | 12/1977 | Cardoso | 292/207 |
| 4,754,624 | 7/1988 | Fleming | 70/95 |
| 4,776,619 | 10/1988 | Daugherty | 292/201 |
| 5,141,267 | 8/1992 | Vigreux | 292/95 |
| 5,542,720 | 8/1996 | Fleming . | |

FOREIGN PATENT DOCUMENTS

| | | |
|---|---|---|
| 220 127 | 4/1987 | European Pat. Off. . |
| 246 172 | 11/1987 | European Pat. Off. . |
| 262 067 | 3/1988 | European Pat. Off. . |
| 2 700 578 | 7/1994 | European Pat. Off. . |
| 0 683 294 | 11/1995 | European Pat. Off. . |
| 695 154 | 12/1930 | France . |
| 2 177 452 | 1/1987 | United Kingdom . |

*Primary Examiner*—Flemming Saether
*Assistant Examiner*—Gary Estremsky
*Attorney, Agent, or Firm*—Kenyon & Kenyon

[57] ABSTRACT

A lock for a sliding door, window or like closure comprises a casing forming a slide fixed relative to a profile and extending substantially in a transverse direction of the profile and a mobile member mounted to slide relative to the casing forming a slide in the transverse direction and fastened to the feeler and to the abutment member.

13 Claims, 2 Drawing Sheets

LOCK FOR SLIDING DOOR, WINDOW OR LIKE CLOSURE

BACKGROUND OF THE INVENTION

1. Field of the Invention

The present invention concerns a lock for a sliding door, window or like closure including a bolt fastened to a sliding assembly mobile relative to a profile forming an integral part of said lock, the lock including an anti-misoperation device.

2. Description of the Prior Art

FR-A-2 700 578 discloses a lock of the above type including an anti-misoperation device comprising a feeler finger mobile substantially in the transverse direction of the profile and spring-loaded by spring means towards its deployed position and an abutment member fastened to the feeler and adapted to cooperate with complementary abutting means of the sliding assembly so that, in the deployed position of the feeler, said abutment member prevents sliding of the bolt towards its locked position but does not oppose such sliding in the retracted position of the feeler.

According to the above document the feeler finger is mounted on a rod, for example a leaf spring. As long as the feeler, not encountering any obstacle, remains in its deployed position, the end of the rod immobilizes a slider carrying a bolt and prevents the bolt sliding towards its locked position.

In contrast, when the feeler comes into contact with a striker the striker pushes back the feeler and the rod which therefore releases the slider to enable the bolt to slide towards its locked position.

This implementation is fragile and unreliable.

The aim of the present invention is to remedy the drawbacks of prior art locks and to propose a lock of the aforementioned type that is simple, economic, extremely reliable and easy to assemble and install.

SUMMARY OF THE INVENTION

In accordance with the present invention, a lock of the above type comprises a casing forming a slide adapted to be fixed relative to the profile and extending substantially in the transverse direction of the profile and a mobile member mounted to slide relative to the casing forming a slide in the transverse direction and fastened to the feeler and the abutment member.

Accordingly, the abutment member and the feeler finger are fastened to the mobile member which is mounted to slide relative to the casing forming the slide which is fixed to the profile. The feeler finger is therefore guided precisely so that it can reliably assure the anti-misoperation device function.

Other features and advantages of the present invention will emerge from the following detailed description.

BRIEF DESCRIPTION OF THE DRAWINGS

In the appended drawings, given by way of non-limiting example only.

DETAILED DESCRIPTION OF THE PREFERRED EMBODIMENTS

Figure 12:
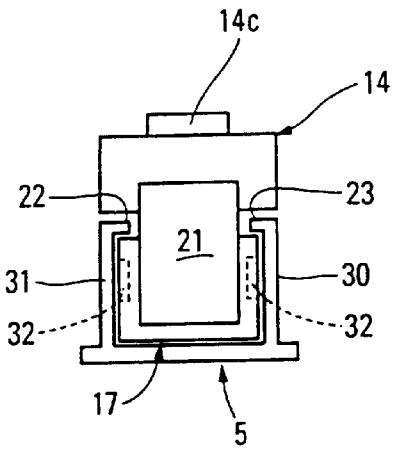
FIG. 12 is a view of the lock from FIG. 1 as seen from the lefthand side in FIG. 1, omitting the closure to simplify the drawing.
Figure 5:
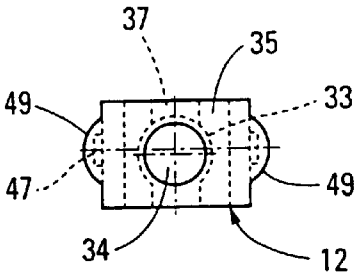
FIG. 5 is an elevation view of the casing from FIGS. 4A and 4B, showing the casing from the side opposite that shown in FIGS. 4A and 4B.

In the embodiment shown in the figures the lock 1 for a sliding door, window or like closure 2 includes a bolt 3 fastened to a sliding assembly 4 shown schematically and mobile relative to a profile 5 forming an integral part of the lock 1 which is housed inside the closure.

Figure 2:
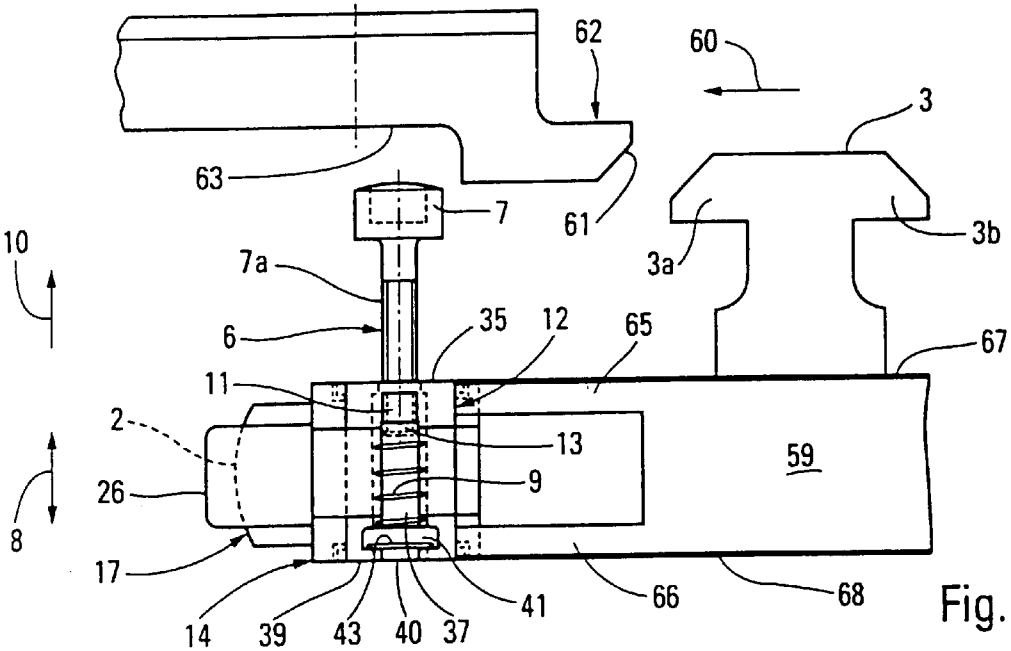
FIG. 2 is a fragmentary top view of the lock from FIG. 1, omitting the profile and the sliding closure in order to simplify the figure, and showing the striker schematically near the bolt and the anti-misoperation device.

The lock 1 includes an anti-misoperation device 6 comprising a feeler finger 7 mobile substantially in the transverse direction 8 of the profile 5 and spring-loaded by spring means 9 towards its deployed position, in the direction symbolized by the arrow 10 in FIG. 2.

Figure 11:
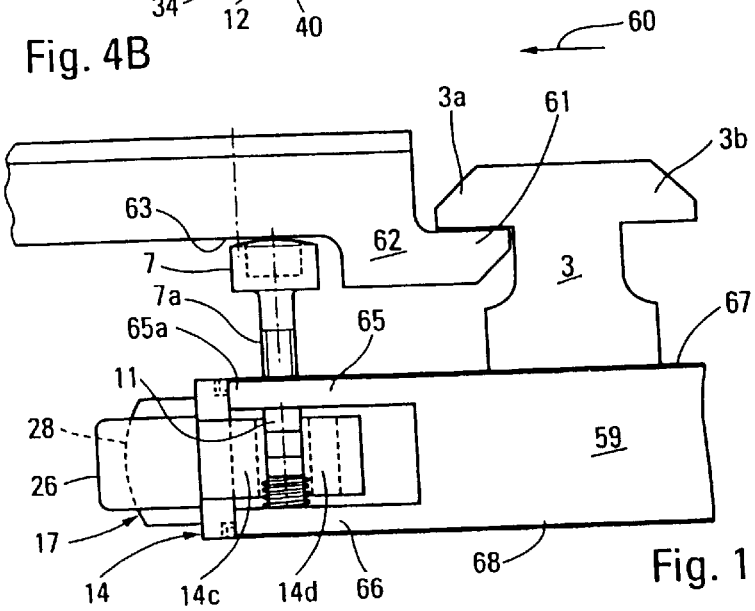
FIG. 11 is a fragmentary view similar to FIG. 2, showing the bolt in the locked position.
Figure 10:
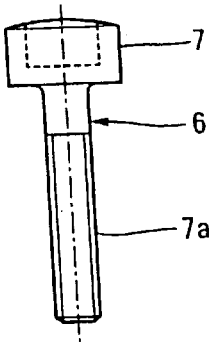
FIG. 10 shows a detail from FIG. 2 representing the feeler fingers.

The anti-misoperation device 6 also includes an abutment member 11 attached to the feeler 7 and adapted to cooperate with complementary abutting means of the sliding assembly 4 so that, in the deployed position of the feeler 7 shown in FIG. 2, said abutment member 11 prevents sliding of the bolt 3 towards its locked position but does not oppose such sliding in the retracted position of the feeler 7 shown in FIG. 11.

As shown in FIG. 2, the bolt 3 includes two opposed hooks 3*a*, 3*b* so that it is reversible so that it can be disposed either way round and on either side of the bolt-carrier 59 mounted on the sliding assembly 4, the type of which is immaterial.

The hook 3*a* is adapted to slide in the direction 60 and in its locked position (FIG. 11) engages with the complementary hook 61 of the striker 62.

This sliding is allowed as soon as the closure 2 carrying the bolt 3 has been moved in the direction 10 towards the frame (not shown) carrying the striker 62 until the feeler 7 comes into contact with the bearing surface 63 attached to the striker 62 and is pushed back by the bearing surface 63, in the direction opposite to the direction 10 relative to the profile 5, to its retracted position shown in FIG. 11.

In accordance with the invention, the lock 1 comprises a casing 12 forming a slide adapted to be fixed relative to the profile 5 and extending substantially in the transverse direction 8 of the profile 5 and a mobile member 13 mounted to slide relative to said casing 12 forming a slide in said transverse direction 8 and attached to said feeler 7 and to said abutment member 11.

In the example shown the casing 12 included means adapted to cooperate with complementary means attached to the profile 5 to fix the casing 12 to said profile 5.

Here the aforementioned means are clipping means.

The lock 1 includes a support 14 fixed to the profile 5 and including a housing 15 adapted to receive the casing 12.

In this example the support 14 of the housing 15 is attached to the body 16 of a fixing member 17 adapted to engage the profile 5 and a transverse edge 18 of a slot 19 in a wall 20 on the inside of the sliding closure 2 in order to clip the profile 5 to the edges of said slot 19 and is attached to a middle part 21 of the body 16 projecting between the two longitudinal edges 22, 23 of the profile 5 (see FIG. 12).

As shown in FIGS. 2, 3, 7 and 12 in particular, the support 14 is fixed to the middle part 21 of the body 16 or forms an integral part of the middle part 21.

The support 14 comprises two transverse walls 14*a*, 14*b* defining between them the housing 15, the back of which is formed by the surface 21*a* of the middle part 21.

To delimit the housing 15 on the side opposite the back 21*a* the support 14 also comprises two flanges 14*c*, 14*d* extending towards each other in the direction 24 from the transverse walls 14*a* and 14*b* and delimiting between them a transverse slot 14*e* in which the abutment member 11 can slide.

The flanges 14*c* and 14*d* extend over only a middle part of the transverse walls 14*a*, 14*b* of the support 14.

Figure 1:
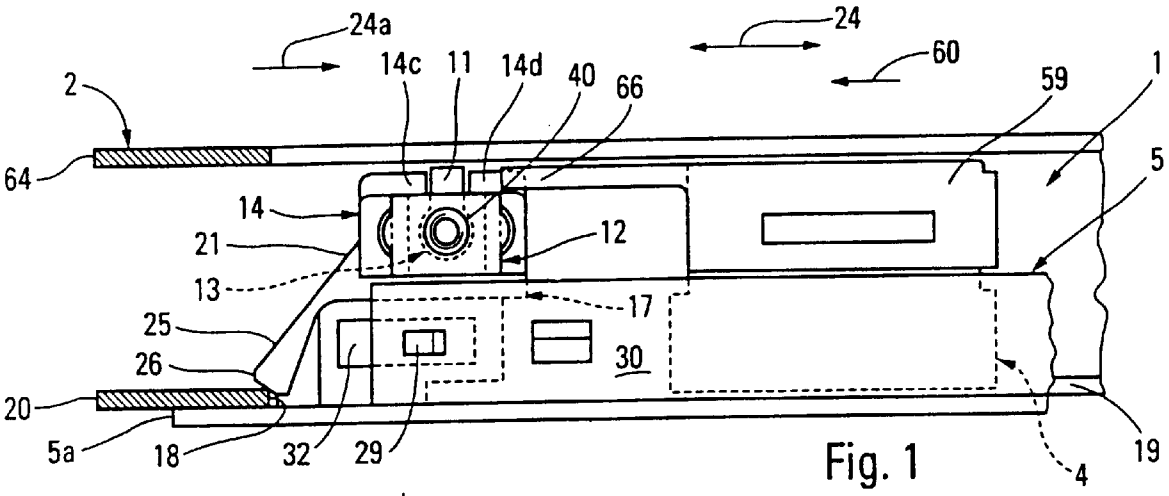
FIG. 1 is an elevation view of one embodiment of the lock in accordance with the present invention, the lock being fitted to a sliding closure and the bolt being in its open position.

FIG. 1 shows that the bolt-carrier 59 projects between the two longitudinal edges 22, 23 of the profile 5 relative to the sliding assembly 4 and, like the support 14, extends between the wall 20 on the inside and the wall 64 on the outside of the closure 2.

The bolt-carrier 59 includes, facing and level with the flanges 14*c*, 14*d*, two arms 65, 66 extending in the longitudinal direction 24 of the profile 5 substantially in alignment with the longitudinal edges 67, 68 of the bolt-carrier 59, on either side of the flanges 14*c*, 14*d*.

FIG. 2 shows that the free end 65*a* of the arm 65 is separated from the abutment member 11 by a space whose function is explained below.

This figure also shows that the abutment member 11 is, in the deployed position of the feeler finger 7, on the path of the free end 65*a* of the arm 65 and opposes movement of the bolt-carrier 59 and the bolt 3 in the direction 60 towards the locked position of the latter.

This prevents any risk of the bolt 3 being damaged by impacting on the striker 62 if the closure 2 is unintentionally closed with the bolt in the locked position.

In contrast, when the feeler finger 7 is in its retracted position as shown in FIG. 11, the abutment member 11 is between the flanges 14*c*, 14*d* and can no longer prevent movement of the arm 65 and sliding of the bolt-carrier 59 and the bolt 3 in the direction 60 towards the locked position of the latter.

Figure 3:
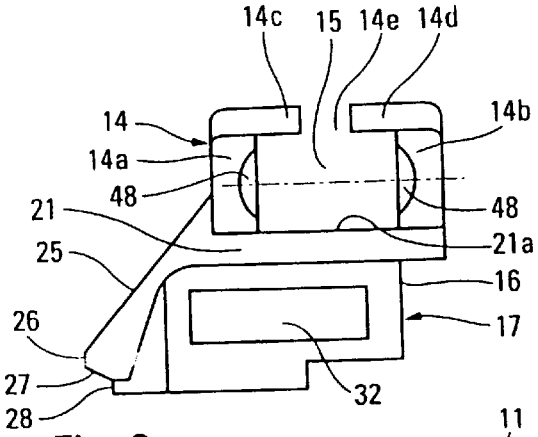
FIG. 3 shows a detail from FIG. 1 representing one embodiment of the support of the casing forming a slide.
Figure 7:
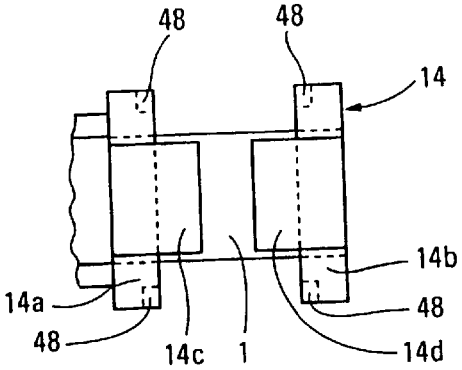
FIG. 7 is a fragmentary top view of the support from FIG. 3.

In this example, and as shown in detail in FIGS. 1 and 3, the fixing member 17 is mobile in the longitudinal direction 24 of the profile 5 of the type described in French patent application No. 97-04065 in the name of the applicant.

The fixing member 17 therefore comprises a ramp 25 extending substantially from the transverse edge 18 of the slot 19 towards the inside of the closure 2 and towards the center of the slot 19. Near the wall 20 of the closure 2 the ramp 25 forms a projecting dihedron 26 continuing through a second ramp 27 terminating at a re-entrant shoulder 28.

If the profile 5 is pressed against the edges of the slot 19, in order to insert it inside the closure 2 via the slot 19, the ramp 25 is pressed against the transverse edge 18 of the slot 19 and forces the fixing member 17 to slide in the direction 24*a* in the longitudinal direction 24 towards the inside of the slot 19 against the action of a spring, not shown.

When the projecting dihedron 26 reaches the edge 18 of the slot 19, a final push on the profile 5 drives said projecting dihedron 26 towards the inside of the closure. The aforementioned spring then pushes the fixing member 17 back in the other direction so that the re-entrant shoulder 28 and the second ramp 27 engage the edge 18 of the slot 19 to clip the profile 5 and the embellisher plate 5*a* onto the wall 20 of the enclosure 2.

During this sliding movement the fixing member 17 is guided by the longitudinal edges 22, 23 of the profile 5 and is held at the end of the profile 5 by a depression 29 on the lateral walls 30, 31 of the profile 5 and constituting a tongue projecting towards the inside of the profile 5 and received in a corresponding groove 32 extending in the longitudinal direction 24 on the two lateral faces of the member 17.

The sliding movement of the fixing member 17 to enable the lock 1 to be clipped to the wall 20 of the closure 2 is made possible by the gap, shown in FIG. 2, between the free end 65*a* of the arm 65 of the bolt-carrier 59, in the open position of the bolt 3, and the abutment member 11 in the deployed position of the feeler finger 7.

The lock 1 and the anti-misoperation device 6 are shaped so that the feeler finger 7 can be mounted on either side of the profile 5.

Figure 4A:
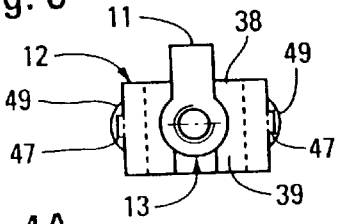
FIGS. 4A and 4B show another detail from FIG. 1 representing one embodiment of the casing forming a slide adapted to cooperate with the support from FIG. 3, showing this casing with the mobile member in FIG. 4A and without the latter member in FIG. 4B.
Figure 6:
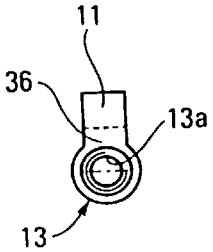
FIG. 6 shows a detail from FIG. 1 representing one embodiment of the mobile member adapted to cooperate with the casing forming a slide from FIGS. 4A, 4B and 5.
Figure 8:
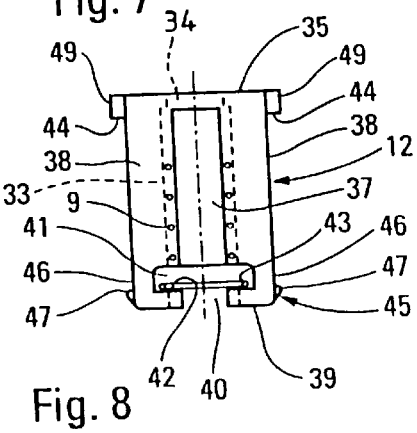
FIG. 8 is a top view of the casing forming a slide from FIGS. 4A and 4B, omitting the mobile member to simplify the figure.
Figure 4B:
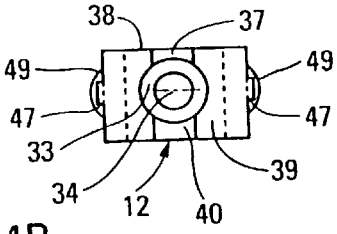
Figure 9:
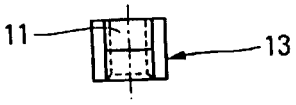
FIG. 9 is a top view of the mobile member from FIG. 6.

The mobile member 13 is mobile along a cavity 33 extending in the transverse direction 8 of the profile inside the casing 12 (see FIGS. 4A, 4B and 8). The feeler finger 7 passes through a hole 34 in a first end wall 35 of the casing 12 substantially perpendicular to the transverse direction 8. The abutment member 11 is joined to the mobile member 13 by a connecting part 36 which passes through a slot 37 in a lateral wall 38 of the casing 12 extending in the transverse direction 8 and slides along the slot 37 in said transverse direction 8.

As shown more precisely in FIG. 8 the cavity 33 and the slot 37 open at the second end wall 39 of the casing 12 into an opening 40 shaped to allow the insertion of the mobile member 13 carrying the abutment member 11 into the casing 12. FIGS. 2, 8 and 11 in particular show that the cavity 33 has, in front of the second end wall 39, a peripheral widening 41 such that the inside surface 42 of the second end wall 39 provides a seat for an enlarged end turn 43 of a coil spring 9 inserted into the cavity 33 between the mobile member 13 and the second end wall 39.

For fixing the casing 12 into the housing 15 of the support 14 the casing 12 includes, near its first end wall 35, abutment means 44 adapted to engage with the support 14 and near its second end wall 39 spring means 45 adapted to clip onto corresponding means of the support 14.

To this end the casing 12 includes near its second end wall 39 at least one flexible flange 46 including a lug 47 projecting towards the outside of the casing and the flange 46 is sufficiently flexible to allow the second end wall 39 of the casing 12 to be inserted into the housing 15, the lug 47 clipping onto the outside edge of the housing 15 as soon as it has left the latter.

In the example shown the peripheral widening 41 provides two flexible flanges 46 having at their end a respective part of the second end wall 39, each flange 46 carrying a lug 47.

As shown in detail in FIGS. 4, 5, 7, 8 and 11, the housing 15 has at each end in said transverse direction 8 two diametrically opposed openings 48 and the casing 12 has in line with its first end wall 35 two diametrically opposed lugs 49 and in line with its second end wall 39 two diametrically opposed lugs 47 each carried by a flange 46, the lugs 49 and the lugs 47 being adapted to be received in the openings 48 in one or other of the ends of the housing 15.

To enable in situ adjustment of the deployed position of the feeler finger 7, the latter is advantageously mounted at the end of an externally screwthreaded rod 7*a* that is screwed into a corresponding screwthreaded bore 13*a* in the mobile member 13.

The structure of the casing 12 forming a slide described hereinabove lends itself very readily to manufacture of the casing from a material that is highly economic, easy to work and easy to shape, for example a plastics material such as polyamide. Likewise the mobile member 13.

Of course, the present invention is not limited to the embodiments just described and many changes and modifications can be made to the latter without departing from the scope of the invention.

For example the symmetrical nature, relative to a longitudinal plane of symmetry of the profile 5, of the fixing member 17, the support 14 and the bolt-carrier 59 enabling the casing 12 and the feeler finger 7, like the bolt 3, to be fitted to either side of the profile 5, can be dispensed with.

A support 14 fixed to the profile 5 in any way can equally be used.

The support 14 and the casing 12 can even have exactly the same dimension in the transverse direction 8, regardless of the width of the profile 5 in the direction 8.

What is claimed is:

1. A lock for a sliding closure such as a door or a window including a bolt fastened to a sliding assembly mobile relative to a profile forming an integral part of said lock, an anti-misoperation device comprising a feeler finger mobile substantially in a transverse direction of said profile and spring-loaded by spring means towards a deployed position of said feeler, an abutment member attached to said feeler and adapted to cooperate with complementary abutting means of said sliding assembly so that said abutment member, in said deployed position of said feeler, prevents sliding of said bolt towards a locked position of said bolt and does not oppose such sliding in a retracted position of said feeler, a casing forming a slide adapted to be fixed relative to said profile and extending substantially in said transverse direction of said profile and a mobile member mounted to slide relative to said casing in said transverse direction and fastened to said feeler and said abutment member, wherein said mobile member is mobile along a cavity, said cavity extending in said transverse direction inside said casing, wherein said feeler finger passes through a hole in a first end wall of said casing, said first end wall substantially perpendicular to said transverse direction, and wherein said abutment member is connected to said mobile member bv a connecting part which passes through a slot in a lateral wall of said casing, said slot extending in said transverse direction and said connecting part slidable along said slot in said transverse direction.

2. The lock of claim 1 wherein said lock and said anti-misoperation device are shaped so that said feeler finger can be mounted on either a first or a second side of said profile.

3. The lock of claim 1 wherein said cavity and said slot open at a second end wall of said casing into an opening shaped to allow insertion of said mobile member carrying said abutment member into said casing.

4. The lock of claim 3 wherein said cavity has, in front of said second end wall, a peripheral widening such that an inside surface of said second end wall provides a seat for an enlarged end turn of a coil spring inserted into said cavity between said mobile member and said second end wall.

5. The lock of claim 1 wherein said casing includes first fixing means adapted to cooperate with complementary second fixing means fastened to said profile for fixing said casing to said profile.

6. The lock of claim 5 wherein said first and second fixing means for fixing said casing to said profile are clipping means.

7. The lock of claim 5 including a support fixed to said profile and including a housing adapted to receive said casing.

8. The lock of claim 7 wherein said casing includes, near said first end wall, abutment means adapted to engage with said support and near a second end wall spring means adapted to clip onto said support.

9. The lock of claim 8 wherein said casing includes near said second end wall at least one flexible flange including a lug projecting towards an outside of said casing and said at least one flexible flange being sufficiently flexible to enable said second end wall of said casing to be inserted in said housing, said lug clipping onto an outside edge of said housing as said lug is pulled to a position outside of said housing.

10. The lock of claim 9 wherein said housing has at opposite ends in said transverse direction two diametrically opposed openings and said casing has level with said first end wall two diametrically opposed lugs and level with said second end wall two diametrically opposed lugs each carried by a flange, said lugs being adapted to be received in said openings in one or the other end of said housing.

11. The lock of claim 7 wherein said support of said housing is fastened to a body of a fixing member adapted to engage with said profile and with a transverse edge of a slot in an inside wall of the sliding closure for clipping said profile to edges of said slot and is in particular fastened to a middle part of said body projecting between two longitudinal edges of said profile.

12. The lock of claim 11 wherein said support comprises two flanges extending towards each other in a longitudinal direction of said profile and delimiting between them a transverse slot in which said abutment member can slide.

13. The lock of claim 12 wherein said flanges extend over only a middle part of said support and a bolt-carrier has, facing and level with said flanges, two arms extending in said longitudinal direction on either side of said flanges, said abutment member being, in said deployed position of said feeler finger, on a longitudinal path of said arms and, said retracted position of said feeler finger, between said flanges.

* * * * *

UNITED STATES PATENT AND TRADEMARK OFFICE

CERTIFICATE OF CORRECTION

PATENT NO. : 6,000,734

DATED : December 14, 1999

INVENTOR(S) : Gerard PREVOT, et al.

It is certified that error appears in the above-identified patent and that said Letters Patent is hereby corrected as shown below:

| Column | Line | |
|---|---|---|
| 6 | 59 | After "arms and," insert --in--. |

Signed and Sealed this

Third Day of April, 2001

Nicholas P. Godici

*Attest:*

NICHOLAS P. GODICI

*Attesting Officer*

*Acting Director of the United States Patent and Trademark Office*